US006684979B1

(12) United States Patent
Nakazato et al.

(10) Patent No.: US 6,684,979 B1
(45) Date of Patent: Feb. 3, 2004

(54) HERMETIC MOTOR-DRIVEN COMPRESSOR

(75) Inventors: Maiko Nakazato, Chigasaki (JP); Akihiko Kubota, Chigasaki (JP); Manabu Motegi, Chigasaki (JP); Masahiko Osaka, Chigasaki (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 10/009,564

(22) PCT Filed: Jun. 14, 2000

(86) PCT No.: PCT/JP00/03840

§ 371 (c)(1),
(2), (4) Date: Feb. 22, 2002

(87) PCT Pub. No.: WO00/77399

PCT Pub. Date: Dec. 21, 2000

(30) Foreign Application Priority Data

Jun. 14, 1999 (JP) ..... 11-166410

(51) Int. Cl.[7] ..... F01M 1/00
(52) U.S. Cl. ..... 184/6.16; 415/88; 417/368
(58) Field of Search ..... 184/6.16, 6.18; 415/88; 417/368, 902

(56) References Cited

U.S. PATENT DOCUMENTS

| | | | | |
|---|---|---|---|---|
| 4,209,080 A | * | 6/1980 | Douglas | 184/6.16 |
| 4,406,590 A | | 9/1983 | Kessler | |
| 4,406,594 A | * | 9/1983 | Smaby et al. | 417/368 |
| 4,493,226 A | | 1/1985 | Andrione et al. | |
| 5,247,736 A | * | 9/1993 | Fraser et al. | 29/888.022 |
| 5,322,419 A | * | 6/1994 | Novolan et al. | 417/363 |
| 5,720,602 A | * | 2/1998 | Hill et al. | 418/55.4 |

FOREIGN PATENT DOCUMENTS

| | | |
|---|---|---|
| GB | 1117298 | 6/1968 |
| GB | 2 315 300 | 1/1998 |
| JP | 61-171887 | 8/1986 |
| JP | 61-244882 | 10/1986 |
| JP | 63-186990 | 8/1988 |
| JP | 8-144950 | 6/1996 |

* cited by examiner

*Primary Examiner*—David Fenstermacher
(74) *Attorney, Agent, or Firm*—Wenderoth, Lind & Ponack, L.L.P.

(57) ABSTRACT

A hermetic motor-driven compressor is capable of decreasing both the resonance sound due to an oil feed pipe and the resonance sound due to a crankshaft generated when the oil feed pipe is rotated while being dipped in the refrigerating machine oil. Within a hermetically sealed enclosure, a compression component and a motor drive component are supported through an elastic support arrangement, and the compression component comprises a crankshaft adapted to be rotatively driven by the motor drive component through an eccentric portion and provided with a journal, a balance weight disposed at the eccentric portion and a coaxial oil feed pipe disposed in the balance weight so as to revolve coaxially with the journal, so that the stirring of the refrigerating machine oil can be suppressed.

14 Claims, 6 Drawing Sheets

HERMETIC MOTOR-DRIVEN COMPRESSOR

TECHNICAL FIELD

The present invention relates to a hermetic motor-driven compressor for use in refrigerators, freezers and other low-temperature appliances.

BACKGROUND ART

Japanese Patent Publication No. 8-144950 discloses hermetic motor-driven compressors. An example of such conventional hermetic motor-driven compressors is disclosed in FIG. 7. Also, FIG. 8 shows a principal portion of a crankshaft of the conventional hermetic motor-driven compressor. In FIGS. 7 and 8, The hermetic motor-driven compressor includes a compression component 2 and a motor drive component 3 in a hermetically sealed enclosure 1, in which refrigerating machine oil 4 is held in the bottom of the hermetically sealed enclosure 1. Refrigerant 14 is filled in a space within the hermetically sealed enclosure 1.

Further, a crankshaft 5 connected rotatably to the motor-driven component 3 has a journal portion that is supported by a bearing 7, and the crankshaft 5 is provided with an eccentric portion 6 that is eccentric relative to the journal portion. An oil feed pipe 8 is fixedly secured to the eccentric portion 6 while the leading end of the oil feed pipe is opened in the refrigerating machine oil 4.

The eccentric portion 6 is connected to a connecting rod 9 which is connected a piston 10 of the compression portion with a piston pin 11 to compress the refrigerant.

In operation of such a hermetic motor-driven compressor, torque of the motor drive component 3 is converted to reciprocating movement through the eccentric portion 6 and the connecting rod 9 so as to perform compression by the piston 10 in the compression component 2.

The crankshaft 5 is rotatively driven by the motor drive component 3 to rotate the oil feed pipe 8 with its centrifugal pumping portion 8*a* dipped in the refrigerating machine oil 4 held within the hermetically sealed enclosure 1 to produce an oil pressure inside of the oil feed pipe 8, so that the refrigerating machine oil 4 can be sucked up by the oil feed pipe 8 and then supplied to every sliding portion in the compressor.

In the above-mentioned arrangement, however, since the centrifugal pumping portion 8*a* is rotated in a dipped manner in the refrigerating machine oil 4, the oil feed pipe 8 runs through the oil 4 while cutting the oil surface like a truncated conical contour to stir the refrigerating machine oil 4 vigorously.

Thereupon, the refrigerant 14 which has dissolved in the refrigerating machine oil 4 forms bubbles, which shake the rotating oil feed pipe 8 to generate the resonance sound. It is problematic that the resonance sound of the pipe 8 increases noise in the hermetic motor-driven compressor together with the oil surface cutting sound produced by the oil feed pipe 8 cutting into the oil surface and the colliding sounds produced by droplets, spattered from the refrigerating machine oil 4 stirred vigorously by the oil feed pipe 8, clashing against the oil surface, the inside wall of the hermetically sealed enclosure, the compression component and so on.

There is also such a problem that the noise in the hermetic motor-driven compressor is increased also by the resonance sound of the crankshaft 5 which is produced by repetition of deflection thereof caused when the crankshaft 5 is oscillated by large intermittent loads acting to the eccentric portion 6 through the connecting rod 9 at the time of compression in the compression component 2. Otherwise, if the oil feed pipe 8 is provided coaxially with the crankshaft 5, the stirring of the refrigerating machine oil may be prevented, but the centrifugal pumping action thereof may be lost, which causes problems with the oil feeding function of the compressor.

DISCLOSURE OF INVENTION

It is an object of the invention to solve the above-mentioned problem in such a way that the noise in the hermetic motor-driven compressor can be reduced by decreasing the resonance sound of the oil feed pipe, the oil surface cutting sound produced by the oil feed pipe rotated in a dipped manner in the oil, the spattering sound of the refrigerating machine oil stirred by the oil feed pipe and the resonance sound of the crankshaft caused by the deflection thereof while the lubrication for the sliding portions of the compression component can be guaranteed.

For accomplishing the above-mentioned object, the present invention contemplates the selection of a material for the oil feed pipe having a natural frequency that is a low frequency which has less influence on the sense of hearing.

Further, a configuration of the oil feed pipe is designed to have a high rigidity or to suppress the stirring of the refrigerating machine oil. Additionally, an interposition member for suppressing the resonance sound of the oil feed pipe is disposed at a joint of the oil feed pipe.

Further, the eccentric portion formed in the crankshaft is provided at its lower portion with a balance weight, and the balance weight has a coaxial oil feed pipe adapted to be rotated coaxially with the journal of the crankshaft.

DETAILED DESCRIPTION OF THE INVENTION

Figure 1:
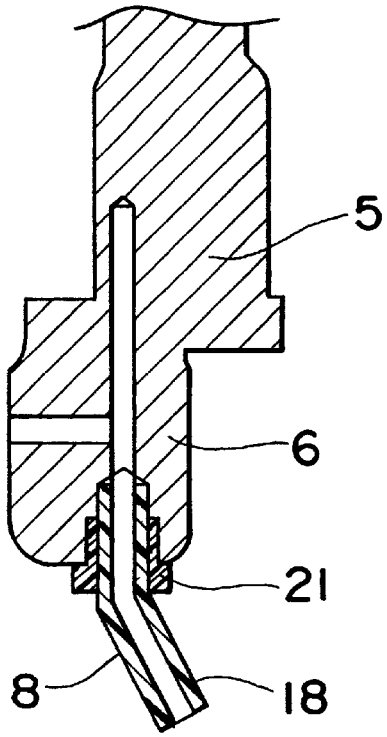
FIG. 1 is a sectional view showing a principal portion of a crankshaft of a hermetic motor-driven compressor according to one embodiment of the present invention.

In the invention of the present invention, an oil feed pipe made of synthetic resin, having a centrifugal pumping action is disposed at an eccentric portion formed in the lower end portion of the crankshaft, and hence has such a function that the generating of noise from the oil feed pipe can be suppressed by shifting the resonance sound of the oil feed pipe to a lower frequency which has less influence on the sense of hearing.

In the invention, also, the oil feed pipe is joined to the eccentric portion formed in the lower end portion of the crankshaft, through an interposition member made of synthetic resin, and hence has such a function that the refrigerating machine oil can be functionally supplied to every sliding portion in the compression component by the centrifugal pumping action of the oil feed pipe, with the function of reducing noise generation of the oil feed pipe by shifting its resonance sound to a lower frequency.

In the present invention, a coaxial oil feed pipe may be adapted to be rotated coaxially with a journal of the crankshaft and disposed in a balance weight portion which has an oil feed bore formed therein and is disposed in the eccentric portion of the crankshaft, and hence has such a function that the refrigerating machine oil sucked up by a pumping action (making use of a centrifugal force) of the coaxial oil feed pipe can be supplied to every sliding portion in the compression component through the bores formed in the balance weight and the crankshaft, and at the same time, has such a function that the generating of the resonance sound of the oil feed pipe by the refrigerant in the refrigerating machine oil, the oil surface cutting sound and the spattering sound of the refrigerating machine oil can be suppressed because the stirring of the refrigerating machine oil by the revolution of the coaxial oil feed pipe can be suppressed more satisfactorily in comparison with in the conventional oil feed pipe.

In the present invention, the coaxial oil feed pipe may be adapted to be rotated coaxially with the journal of the crankshaft and made integral with the balance weight portion provided in the eccentric portion of the crankshaft, and hence has such a function that the generating of noise from the oil feed pipe can be suppressed to decrease the noise in the hermetic motor-driven compressor by increasing the rigidity of the oil feed pipe and shifting the resonance sound of the oil feed pipe to a lower frequency which has less influence on the sense of hearing.

The present invention provides the oil feed pipe made of synthetic resin, adapted to be rotated coaxially with the journal of the crankshaft and disposed at the balance weight portion provided in the eccentric portion of the crankshaft, and hence has such a function that the generating of noise from the oil feed pipe can be suppressed by shifting the resonance sound of the oil feed pipe to a lower frequency which has less influence on the sense of hearing to reduce the noise in the hermetic motor-driven compressor.

The present invention also provides the oil feed pipe adapted to be rotated coaxially with the journal of the crankshaft and joined to the balance weight portion provided in the eccentric portion of the crankshaft, through an interposition member made of synthetic resin, and hence has such a function that the resonance sound of the oil feed pipe can be suppressed more effectively and the generating of noise from the oil feed pipe can also be suppressed.

The hermetic motor-driven compressor in the present invention may have an auxiliary means for increasing the pumping action such as a coil spring disposed within the coaxial oil feed pipe and hence has such a function that an amount of the refrigerating machine oil to be supplied to the sliding portions can be increased by this auxiliary means to improve the lubricating performance.

Now, some embodiments of the present invention will be explained with reference to the drawings hereinafter. By the way, the same portions as those in the conventional example will be designated by the same reference numerals, and detailed explanations thereof will be omitted.

Embodiment 1

In FIG. 1, in this embodiment an oil feed pipe 18 made of synthetic resin is used, as an oil feed pipe 8, which is fixedly secured to a lower portion of the crankshaft 5 so that its leading end opens in the refrigerating machine oil and which has a centrifugal pumping action as well known in the art.

In the hermetic motor-driven compressor constructed as mentioned above, the crankshaft 5 is rotated by the motor drive component, and also the oil feed pipe 18 fixedly secured to its lower end portion is rotated together with the crankshaft.

Thereupon, the oil surface of the refrigerating machine oil is stirred by the revolution of the oil feed pipe 18, so that refrigerant having dissolved in the refrigerating machine oil forms bubbles. Though the oil feed pipe 18 revolving in the refrigerating machine oil is shaken by those bubbles, the generating of the noise from the oil feed pipe 18 can be suppressed by selecting synthetic resin as a material of the oil feed pipe 18 so as to shift the resonance sound of the oil feed pipe to a is lower frequency which has less on the sense of hearing.

Embodiment 2

With reference to FIG. 1 again, numeral 21 designates an interposition member made of synthetic resin, which is disposed at a joint portion between the crankshaft 5 and the oil feed pipe 18, so that the resonance sound of the oil feed pipe 18 is shifted to a lower frequency which has less influence on the sense of hearing to suppress the generation of the noise from the oil feed pipe 18.

Embodiment 3

Figure 2:
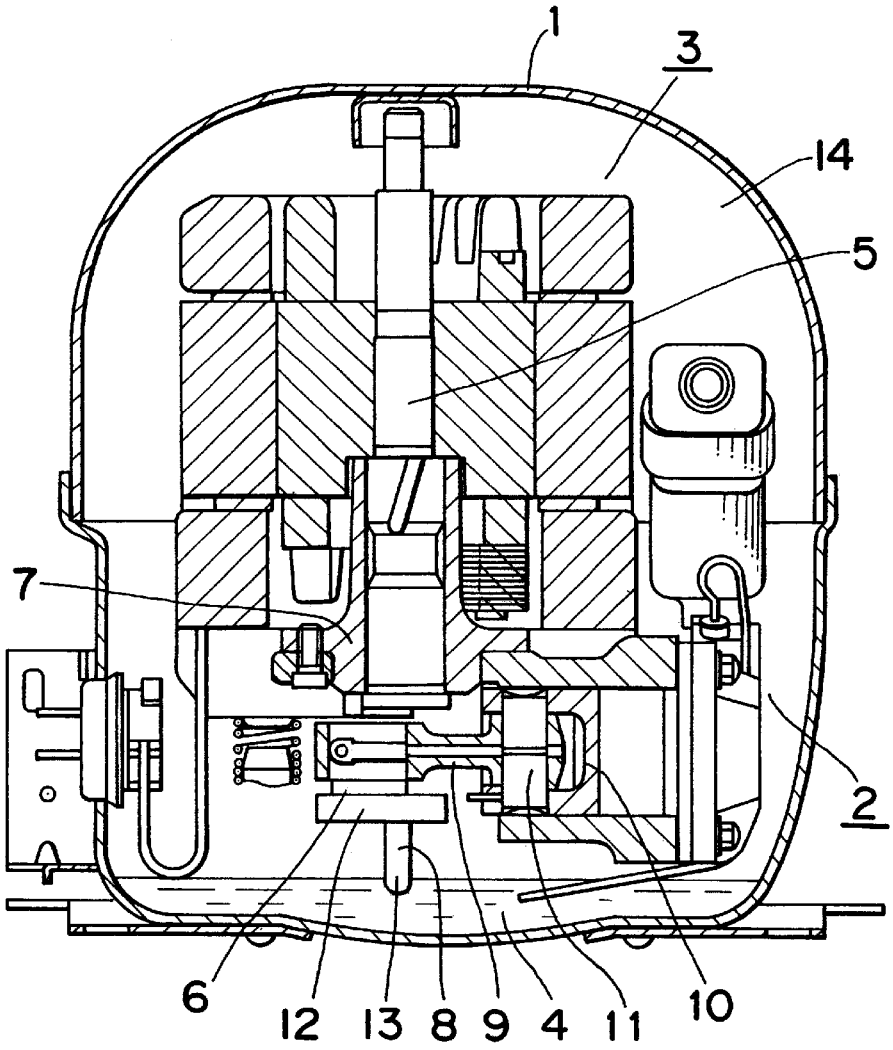
FIG. 2 is a vertical sectional view of the hermetic motor-driven compressor according to one embodiment of the present invention.

In FIG. 2, a balance weight 12 is fixedly secured to the crank eccentric portion 6, and, as the oil feed pipe 8, a coaxial oil feed pipe 13 is fixedly secured to the balance weight 12. The coaxial oil feed pipe 13 has a pumping action effected by the revolution of its lower end approximately formed in a conical shape.

When the crankshaft 5 is rotated by the motor drive component 3, the coaxial oil feed pipe 13 fixedly secured to the balance weight 12 provided in the eccentric portion 6 is also rotated together with the crankshaft.

Thereupon, since the coaxial oil feed pipe 13 revolving in the refrigerating machine oil 4 is coaxial with the crankshaft, the stirring of the refrigerating machine oil by that revolution can be suppressed satisfactorily in comparison with the conventional case.

Therefore, the generation of the resonance sound of the oil feed pipe by the refrigerant dissolved in the refrigerating machine oil, the oil surface cutting sound, and the spattering sound of the refrigerating machine oil can be suppressed.

Embodiment 4

Figure 3:
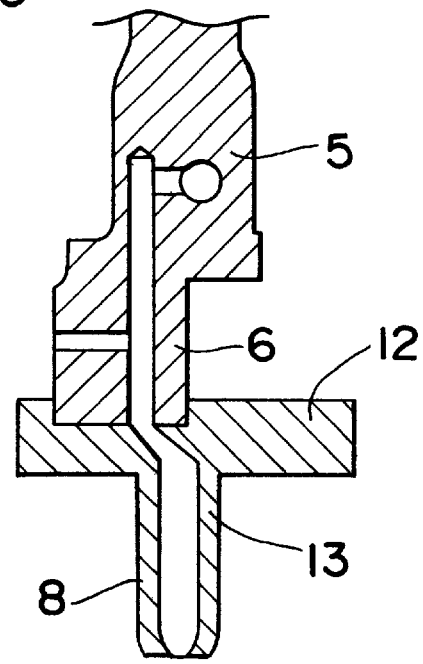
FIG. 3 is a sectional view showing a principal portion of a crankshaft according to another embodiment of the present invention.

In this embodiment, as shown in FIG. 3, a coaxial oil feed pipe 13 is formed integrally with a balance weight 12. Since the coaxial oil feed pipe 13 is formed integrally with the balance weight 12, its rigidity is increased, so that the resonance sound of the oil feed pipe is shifted to a lower frequency which has less influence on the sense of hearing to suppress the generation of the noise from the oil feed pipe.

Embodiment 5

Figure 4:
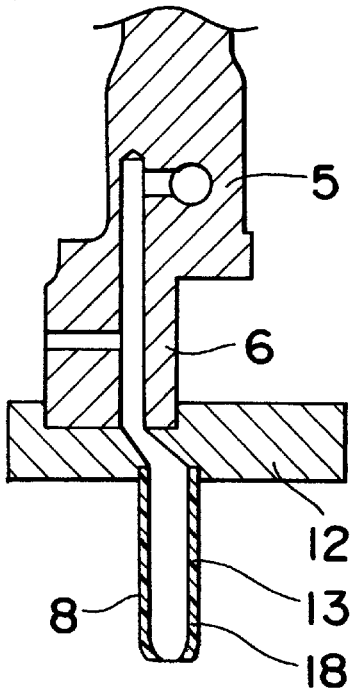
FIG. 4 is a sectional view showing a principal portion of a crankshaft according to still another embodiment of the present invention.

FIG. 4 shows a coaxial oil feed pipe 13 which is constituted by a synthetic resin coaxial oil feed pipe 18. Since the synthetic resin is selected as the material of the oil feed pipe, the resonance sound of the oil feed pipe is shifted to a lower frequency which has less influence on the sense of hearing to suppress the generation of the noise from the oil feed pipe.

Embodiment 6

Figure 5:
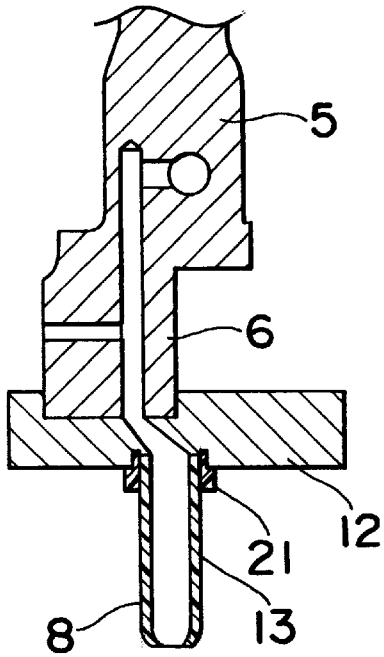
FIG. 5 is a sectional view showing a principal portion of a crankshaft according to a further embodiment of the present invention.

In FIG. 5, an interposition member 21 made of synthetic resin is disposed at a joint portion between the balance weight 12 and the coaxial oil feed pipe 13. Since such an interposition member 21 is disposed at the joint portion, the resonance sound of the oil feed pipe can be suppressed and the generation of the noise from the oil feed pipe can also be suppressed. In this case, the coaxial oil feed pipe 13 may preferably be formed of synthetic resin to reduce its resonance frequency and intensity.

Embodiment 7

Figure 6:
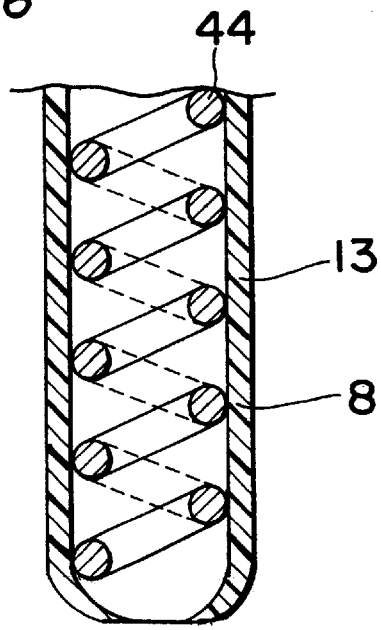
FIG. 6 is a sectional view of the oil feed pipe showing a still further embodiment according to the present invention.
Figure 7:
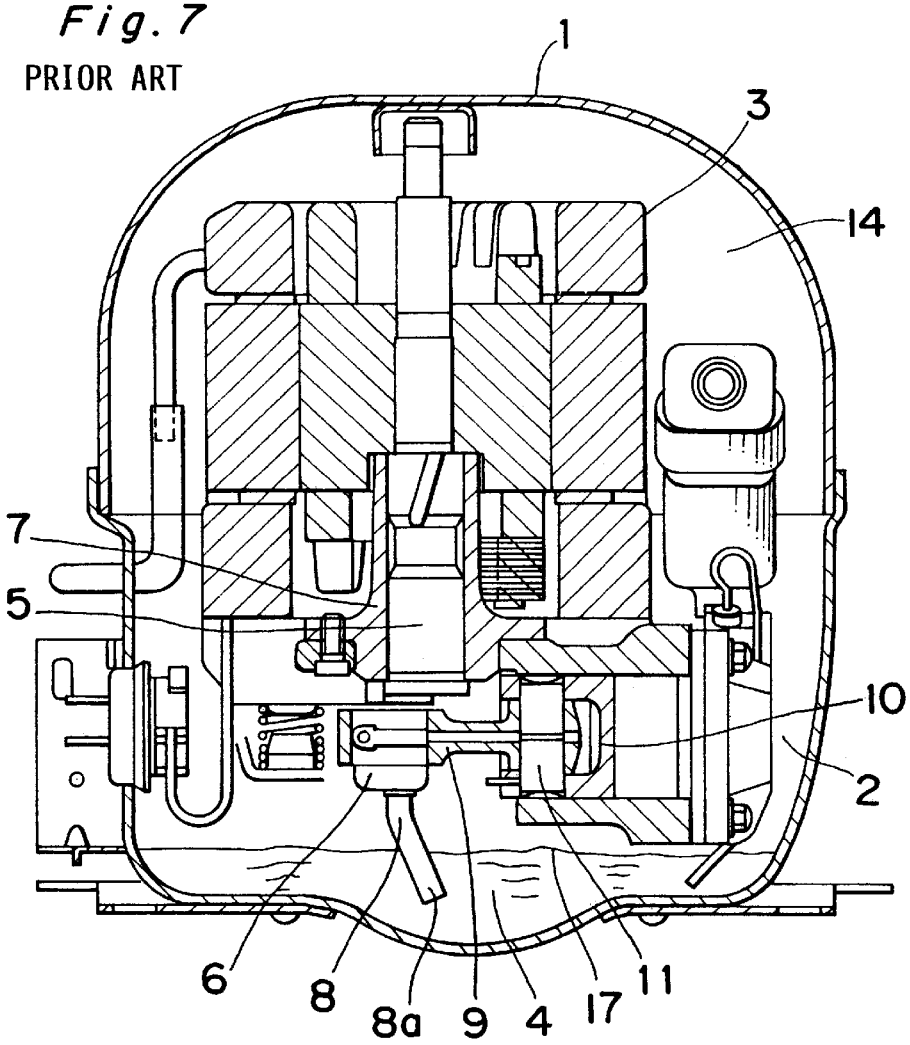
Fig. 7 PRIOR ART
FIG. 7 is a sectional view showing a conventional hermetic motor-driven compressor.
Figure 8:
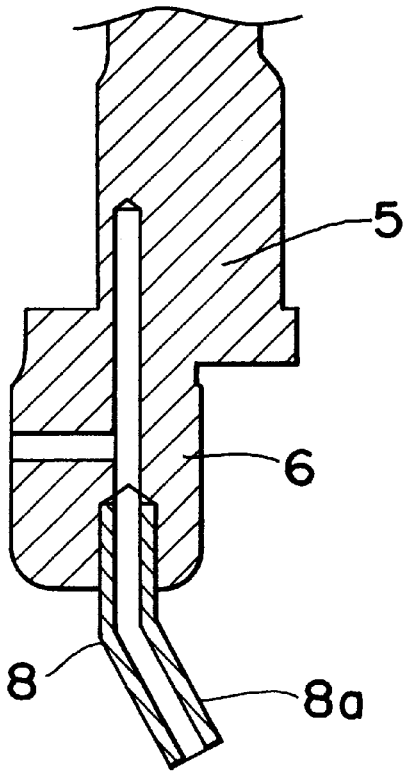
Fig.8 PRIOR ART
FIG. 8 is a sectional view of a principal portion of a crankshaft of the conventional hermetic motor-driven compressor.

In FIG. 6, a coil spring 44 is disposed inside a coaxial oil feed pipe 13. The coil spring 44 is an auxiliary means for increasing the pumping action, and besides various kinds of auxiliary means such as a spiral plate and conical formation of the oil feed bore itself as well known in the art may be employed. Since such an auxiliary means is employed, an amount of the refrigerating machine oil to be supplied can be increased while the stirring action is suppressed thereby.

INDUSTRIAL APPLICABILITY

The hermetic motor-driven compressors of the present invention are highly applicable to fields in the production industry for refrigerating and cold storage machinery.

What is claimed is:

1. A hermetic motor-driven compressor having a compression component and a motor drive component supported through an elastic support arrangement within a hermetically sealed enclosure, wherein the compression component comprises:

a crankshaft having an eccentric portion and adapted to be rotatively driven by the motor drive component; and an oil feed pipe disposed at a lower end portion of said eccentric portion of said crankshaft so as to perform a centrifugal pumping action, said oil feed pipe being arranged to open into a refrigerating machine oil portion of the hermetically sealed enclosure so as to open into refrigerating machine oil held in the refrigerating machine oil portion of the hermetically sealed enclosure and so as to be rotated by said crankshaft;

wherein said oil feed pipe is made of synthetic resin;

wherein said oil feed pipe is joined to said lower end portion of said crankshaft through an interposition member made of synthetic resin; and wherein said interposition member is a separate and discrete member from said oil feed pipe.

2. The hermetic motor-driven compressor according to claim 1, wherein said interposition member is engaged in a lower end of said eccentric portion of said crankshaft and surrounds said oil feed pipe.

3. The hermetic motor-driven compressor according to claim 1, wherein said crankshaft includes a journal portion, and said crankshaft is coupled to said motor drive component so as to be rotatively driven about an axis of said journal portion; and said oil feed pipe is coupled to said eccentric portion of said crankshaft so as to be coaxial with said axis of said journal portion of said crankshaft.

4. The hermetic motor-driven compressor according to claim 1, wherein said oil feed pipe is constituted by a straight pipe so that a lower opening thereof that opens into said refrigerating machine oil portion is aligned coaxially with an uppermost opening thereof.

5. A hermetic motor-driven compressor having a compression component and a motor drive component supported through an elastic support arrangement within a hermetically sealed enclosure, wherein the compression component comprises:

a crankshaft having a journal portion and an eccentric portion, said eccentric portion being disposed eccentrically relative to said journal portion, said crankshaft being adapted to be rotatively driven by the motor drive component about an axis of said journal portion;

a balance weight disposed at said eccentric portion of said crankshaft; and a coaxial oil feed pipe disposed at said balance weight and so as to be coaxial with said axis of said journal portion of said crankshaft so as to perform a pumping action, said coaxial oil feed pipe being arranged to open into a refrigerating machine oil portion of the hermetically sealed enclosure so as to open into refrigerating machine oil held in the refrigerating machine oil portion of the hermetically sealed enclosure and so as to be rotated by said crankshaft;

wherein said compression component is disposed under said motor drive component;

wherein said eccentric portion of said crankshaft is provided at a lower side portion of said crankshaft, an upper side portion of said crankshaft being adapted to be rotatively driven by said motor drive component;

wherein said balance weight is disposed at a lower end portion of said eccentric portion of said crankshaft; and wherein said coaxial oil feed pipe is disposed at a lower end portion of said balance weight.

6. The hermetic motor-driven compressor according to claim 5, wherein said coaxial oil feed pipe is integral with said balance weight.

7. The hermetic motor-driven compressor according to claim 5, wherein said coaxial oil feed pipe is made of synthetic resin.

8. The hermetic motor-driven compressor according to claim 7, wherein said coaxial oil feed pipe is joined to said balance weight through an interposition member made of synthetic resin; and wherein said interposition member is a separate and discrete member from said oil feed pipe.

9. The hermetic motor-driven compressor according to claim 8, wherein a coil spring is disposed within said coaxial feed pipe as a means for enhancing the pumping action.

10. The hermetic motor-driven compressor according to claim 7, wherein a coil spring is disposed within said coaxial feed pipe as a means for enhancing the pumping action.

11. The hermetic motor-driven compressor according to claim 6, wherein a coil spring is disposed within said coaxial feed pipe as a means for enhancing the pumping action.

12. The hermetic motor-driven compressor according to claim 5, wherein a coil spring is disposed within said coaxial feed pipe as a means for enhancing the pumping action.

13. The hermetic motor-driven compressor according to claim 5, wherein said coaxial oil feed pipe is joined to said balance weight through an interposition member made of synthetic resin; and wherein said interposition member is a separate and discrete member from said oil feed pipe.

14. The hermetic motor-driven compressor according to claim 5, wherein said oil feed pipe is constituted by a straight pipe so that a lower opening thereof that opens into said refrigerating machine oil portion is aligned coaxially with an uppermost opening thereof.

* * * * *